US005235882A

United States Patent [19]

Rabourn

[11] Patent Number: 5,235,882

[45] Date of Patent: Aug. 17, 1993

[54] DEVICE FOR TRIMMING AND CUTTING COMPUTER PRINTER PAPER

[76] Inventor: William B. Rabourn, Rte. 1, Box 126, Sedalia, Mo. 65301

[21] Appl. No.: 892,538

[22] Filed: May 26, 1992

[51] Int. Cl.[5] ..... B65H 35/10; B26F 3/02

[52] U.S. Cl. ..... 83/76.1; 83/255; 83/278; 83/365; 83/367; 83/371; 83/408; 83/425.4; 83/505; 83/508.1; 83/588; 83/636; 83/651.1; 83/662; 83/902; 83/945; 83/949; 225/105; 400/621.1

[58] Field of Search ..... 83/76.1, 94, 212.1, 83/241, 255, 267, 278, 363, 365, 367, 371, 408, 423, 425.4, 425.3, 435, 505, 508.1, 508.3, 575, 588, 636, 651.1, 662, 697, 902, 945, 949; 225/104, 105, 93, 97, 100, 103, 106; 400/621.1

[56] References Cited

U.S. PATENT DOCUMENTS

| | | | |
|---|---|---|---|
| 2,252,734 | 8/1941 | Sherman | 225/105 X |
| 2,380,949 | 8/1945 | Davidson | 83/94 X |
| 3,863,821 | 2/1975 | Van Bennekom | 225/105 X |
| 4,623,081 | 11/1986 | Hain et al. | 225/105 |
| 4,697,726 | 10/1987 | Gaucher | 225/106 X |
| 4,721,058 | 1/1988 | Hayamizu et al. | 83/371 X |
| 4,784,318 | 11/1988 | Bay | 83/371 X |
| 4,862,378 | 8/1989 | Melton et al. | 225/100 X |
| 5,067,380 | 11/1991 | Seefeldt | 83/505 X |
| 5,104,022 | 4/1992 | Nakamura et al. | 83/365 X |
| 5,120,144 | 6/1992 | Lund | 225/100 X |

FOREIGN PATENT DOCUMENTS

| | | | |
|---|---|---|---|
| 3718082 | 12/1988 | Fed. Rep. of Germany | 83/651.1 |
| 2556654 | 6/1985 | France | 400/621.1 |

*Primary Examiner*—Frank T. Yost
*Assistant Examiner*—Raymond D. Woods
*Attorney, Agent, or Firm*—Kokjer, Kircher, Bowman & Johnson

[57] ABSTRACT

A device which trims off the perforated margin strips of printer paper and cuts the paper transversely to separate it into individual pages. The paper which discharges from the printer is drawn around a tension bar and is applied to a toothed belt driven by feed wheels. Cutter wheels act against a grooved roller to cut along the tear lines of the margin strips. A photocell based counting system counts the perforations which pass the photocell to indicate each time the paper is advanced to position one of the transverse fold lines at a cutting station. Then, the paper is stopped and a cutter wire is pulled through the fold line to separate the leading page from the rest of the paper sheet. Each time a new sheet of paper is loaded, a special control circuit assures that the initial advance of the sheet stops with the leading edge of the paper at the cutting station.

14 Claims, 3 Drawing Sheets

DEVICE FOR TRIMMING AND CUTTING COMPUTER PRINTER PAPER

FIELD OF THE INVENTION

This invention relates generally to the handling of paper discharged from an automated printer. More particularly, the invention is directed to a device which trims the perforated margin strips of printer paper and cuts the paper sheet into individual pages.

BACKGROUND OF THE INVENTION

Automatic printers have in recent years become common place in offices and a wide variety of businesses. The paper on which material is printed is normally provided in a continuous sheet which is fed through the printer. The paper has margin strips on its side edges which are provided with spaced apart perforations for receiving the teeth of drive sprockets which are used to advance the paper through the printer. The margin strips are connected with the main body of the paper sheet by weakened tear lines. The individual pages of the printer paper are connected along transverse fold lines about which the sheet may be folded up for easier handling. The fold lines are weakened so that the individual pages can be separated from one another.

After the paper has been discharged from the printer, the margin strips must be torn away, usually by hand. This not only increases the time and labor involved in the printing process, but it also can result in inadvertent tearing of the main body of the sheet because of inattention, carelessness or other reasons. Likewise, the individual sheets must be separated and this is most often a manual operation. Again, the time and labor costs are increased and there is a risk that the paper will be torn inaccurately from time to time.

SUMMARY OF THE INVENTION

The present invention is directed to a printer accessory which may be provided either as a part of the printer or as an attachment which may be added to the printer. The printer accessory receives the printer paper sheet which discharges from the printer and operates automatically to accurately trim the margin strips if desired and separate the individual pages by cutting the sheet along each transverse fold line.

In accordance with the invention, the paper discharging from the printer is drawn around a pivotal tension bar and is applied to a toothed belt which is driven by feed wheels. The teeth of the drive belt are received in the perforations of the margin strips on the papers so that the belt is able to advance the paper when the feed wheels are rotated. The paper is advanced to a pair of cutter wheels which are opposed by a grooved roller. The cutter wheels are spaced apart and have sharp cutting edges which effect cut along the tear lines for trimming of the margin strips away from the paper sheet. The cutter wheels may be adjusted toward and away from one another to accommodate paper which differs in width. The cutter wheels can also be retracted away from the sheet if the margin strips are not to be cut away.

A photocell is situated along the path of the paper in alignment with the perforations on the margin strips. This arrangement provides a count of the perforations as they pass the photocell, and the number of perforations which are counted is used to provide a measure of the length of each page on the sheet. Each time one of the tear lines is advanced to a cutting station, the drive motor is stopped and a solenoid is energized to drive a cutter wire through the fold line in order to separate the leading page from the rest of the sheet. Take up rollers downstream from the cutting station receive the paper and advance the pages one at a time into a tray or other container where they are stacked.

The invention is characterized by a unique control system which provides automatic operation of the device with minimal operator input. The leading edge of each printer sheet is initially advanced to a position where it aligns with the cutter wire during a start up cycle. Each time a new sheet is initially loaded into the device, the drive motor is stopped when the counter reaches a count state sufficient to advance the leading edge of the sheet into alignment with the cutter wire. Thereafter, the paper is advanced incrementally by a distance equal to the length of each individual page so that the fold lines are successively aligned with the cutter wire. A perforation count value which corresponds to the distance between fold lines (the length of each page) is entered to achieve this result, and the count value can be changed when paper having a different length is being handled. In this fashion, the control system and cutter wire act to separate each page from the sheet of printer paper.

The control system also operates in a manner to maintain synchronization with the printer drive system. If the printer drive mechanism is stopped, the drive motor of the accessory device pulls the paper forwardly until its tension is increased enough to pivot the tension bar. The tension bar then trips a microswitch which deactivates the drive motor until the printer drive system starts again to relieve the tension of the paper.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
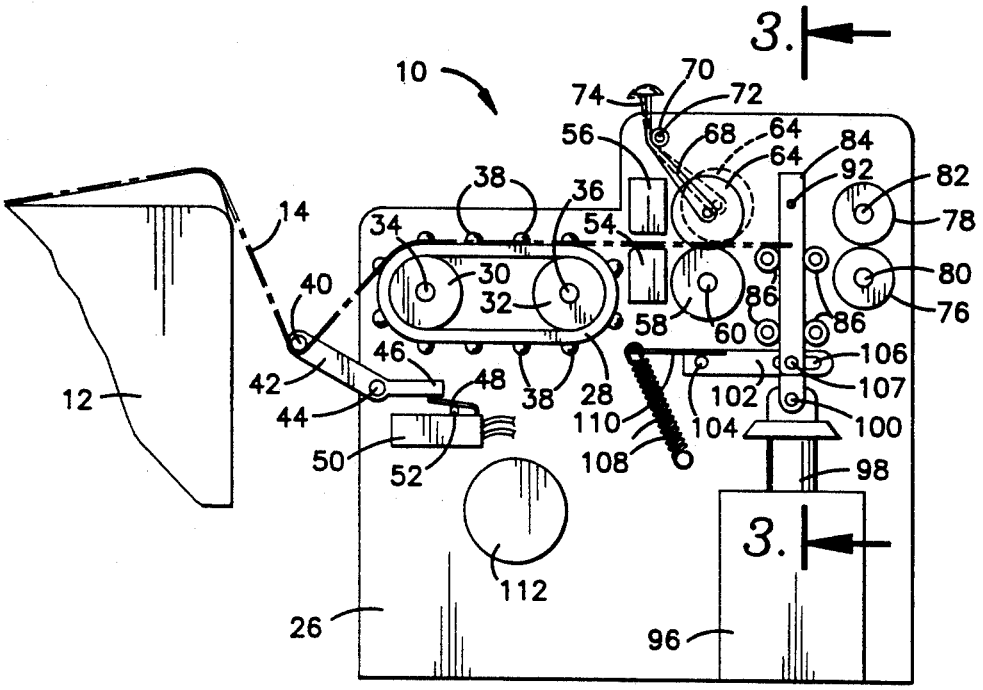
FIG. 1 is a diagrammatic side elevational view of a printer accessory constructed according to a preferred embodiment of the present invention, with the printer shown only partially and the leading edge of the printer paper advanced to the cutting station at the end of a start cycle of the device.

Referring now to the drawings in more detail and initially to FIG. 1, numeral 10 generally designates an accessory device which is constructed in accordance with the present invention and which is used with a conventional printer identified by numeral 12. The printer 12 is of the type that is controlled by a computer and prints on computer paper which is discharged from the printer 12 in a continuous sheet 14.

Figure 4:
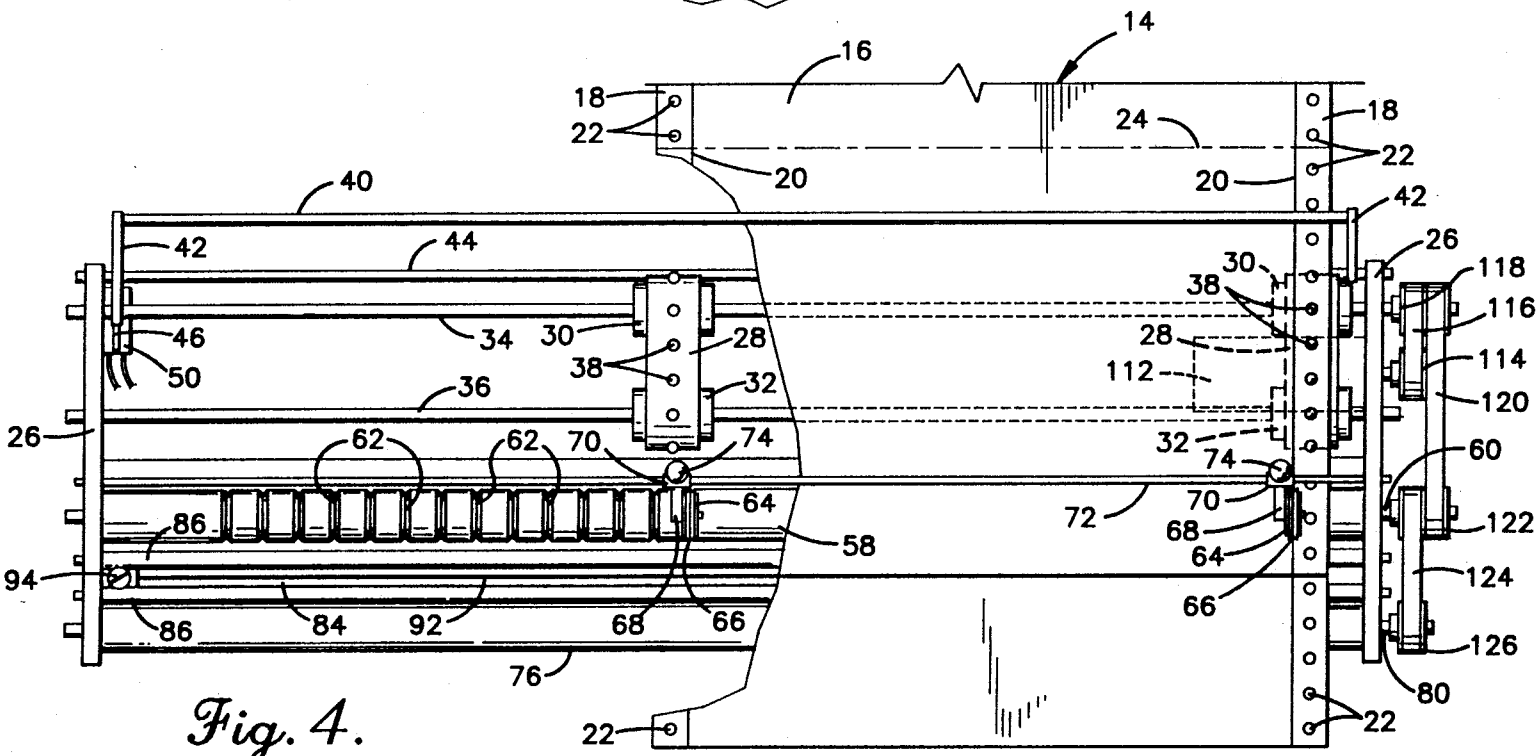
FIG. 4 is a fragmentary top plan view of the printer accessory, with portions broken away for purposes of illustration.

As best shown in FIG. 4, the sheet 14 of computer paper has a main body 16 on which printing takes place. Extending longitudinally along the opposite side edges of the main body 16 of the sheet are a pair of perforated margin strips 18 which are connected to the main body 16 by weakened tear lines 20. Each of the margin strips 18 is provided with a plurality of equally spaced perforations 22 which receive the teeth of drive sprockets (not shown) of the printer 12 in order to advance the paper sheet 14 through the printer. Transverse fold lines 24 are provided across the sheet 14 and are spaced equally apart from one another along the length of the sheet 14. The individual pages of the sheet may be folded about the fold lines 24 and arranged in a stack. Each fold line 24 is serrated or otherwise weakened to provide a frangible line about which the individual pages may be torn away from the sheet 14.

Referring again to FIGS. 1 and 2 in particular, the accessory device 10 may be constructed as an original part of the printer 12, or it may be provided as an accessory which may be added to an existing printer. In either case, the device 10 has a rigid frame 26. The device includes a pair of toothed drive belts 28 which are drawn around sets of feed wheels 30 and 32. Each of the feed wheels 30 is rigidly mounted on a driven shaft 34 which extends across the device between opposite sides of the frame 26. Shaft 34 is suitably supported for rotation on the frame. Each of the other feed wheels 32 is an idler wheel mounted on a transverse idler shaft 36. The belts 28 are drawn tightly around the feed wheels 30 and 32 and are driven by the drive wheels 30 of the feed wheel mechanism.

Each belt 28 has a plurality of outwardly projecting teeth 38. The teeth 38 are spaced apart from one another the same distance as the spacing between adjacent perforations 22 in the margin strips. Each tooth 38 has a size to fit closely through the perforations 22. The paper sheet 14 is applied to the drive belt 28 by placing the leading portion of the sheet 14 on top of the upper run of the drive belt with the perforations 22 fitting on the teeth 38. As the teeth are advanced with the belt 28, the paper 14 is pulled in a direction to advance through the accessory device 10.

With particular reference to FIG. 4, one set of drive wheels 30 and 32 (the set that appears on the right in FIG. 4) is fixed in place on the shafts 34 and 36. Each of the other feed wheels 30 and 32 may be adjusted along the length of its shaft 34 and 36 in order to permit adjustment of the distance between the two drive belts. When the adjustable feed wheels 30 and 32 have been moved to the desired position, they can be secured in place on their shafts. This permits printer paper which differs in width to be handled by the device 10.

The sheet 14 is drawn beneath a tension bar 40 which is located between the printer 12 and the belts 28. Bar 40 extends transversely between the outer ends of a pair of levers 42 which are mounted to pivot on a common horizontal shaft 44. The shaft 44 extends across the width of the frame 26 between its opposite sides. One of the levers 42 has a projecting arm 46 which engages an actuator 48 of a microswitch 50. The actuator 48 is normally urged upwardly to an open condition of the microswitch 50. However, when the tension of the paper sheet 14 is increased sufficiently, the paper pulls the tension bar 40 upwardly, thus pivoting the levers 42 in a clockwise direction (as viewed in FIGS. 1 and 2) about the rod 44. The arm 46 then pushes the switch actuator 48 downwardly and causes it to depress a plunger 52 of the switch, thus placing the microswitch in a closed condition. When the tension in the paper is relieved, the switch actuator 48 returns to its normal upwardly extending position and pushes arm 46 upwardly. This pivots arms 42 in a counterclockwise direction to lower the tension bar 40 to its normal position. The switch plunger 52 is then extended again to place the microswitch 50 in its normal open condition.

At a location immediately downstream from the feed wheels 32, a photoemitter 54 and photoreceiver 56 are mounted on the frame 26 and are aligned with one another. The photoemitter 54 is located immediately below one of the margin strips 18 and the photoreceiver 56 is located immediately above the margin strip so that it receives light emitted by the photoemitter each time one of the perforations 22 passes the location of the photocell. As will be explained more fully, the photocell is used to count the perforations 22 in order to provide information as to the locations of the fold lines 24.

Immediately downstream from the photocell, a grooved roller 58 is mounted on a driven shaft 60. The sheet 14 passes immediately above the roller 58. As best shown in FIG. 4, roller 58 is provided with tapered grooves 62 which are spaced apart from one another, preferably in one-half inch increments. Shaft 60 is supported for rotation and extends between the opposite sides of the frame 26.

A pair of cutter wheels 64 are located immediately above the grooved roller 58 in opposition to it. The periphery of each cutter wheel 64 tapers to a sharp cutting edge 66 extending around the periphery of the wheel. The cutting edges 66 are used to effect cuts along the weakened tear lines 2 of the printer sheet.

Each of the cutter wheels 64 is mounted to turn on the lower end of a lever 68. Sleeves 70 which are connected with the lever 68 are fitted on a horizontal rod 72 extending across the width of the frame. The sleeves 70 are able to turn on the rod 72. Consequently, a handle 74 which projects upwardly from each arm 68 may be pulled to the broken line position of FIG. 1, thus pivoting the sleeve 70 and raising the cutter wheel 64 to the release position shown in broken lines in FIG. 1. In the release position, the cutter wheel is disengaged and does not contact the sheet 14. The handle 74 can be pushed forwardly to move the cutter wheel downwardly to the engaged position shown in solid lines in FIG. 1 and also in FIG. 2. In the engaged position the cutter wheel fits into the aligned groove 62 of the underlying back up roller 58 and effects a cut through the paper along the tear line 20 as the sheet is advanced through the device. The two cutter wheels 64 are independently adjustable between the engaged and release positions. One of the sleeves 70 (the sleeve on the left as viewed in FIG. 4) may be adjusted along rod 72 to accommodate paper of different width.

The sheet 14 fits closely between a pair of take up rollers 76 and 78. The bottom take up roller 76 is a driven roller which is mounted on a drive shaft 80 which extends across the width of the frame. The top take up roller 78 is an idler roller which is mounted on an idler shaft 82. The sheet 14 is gripped between the two take up rollers 76 and 78 and is advanced when the driven roller 76 is rotated.

At a cutting station located between the cutter wheels 64 and the take up rollers 76 and 78, a cutting mechanism acts to effect transverse cuts which separate the pages of the sheet 14 along the fold lines 24. The cutting mechanism includes a reciprocating cutter bar 84 which fits closely between upper and lower pairs of guide rollers 86. The guide rollers 86 and 88 assure that the cutter bar 84 is restricted to reciprocating up and down movement between the positions shown in FIGS. 1 and 2.

Figure 2:
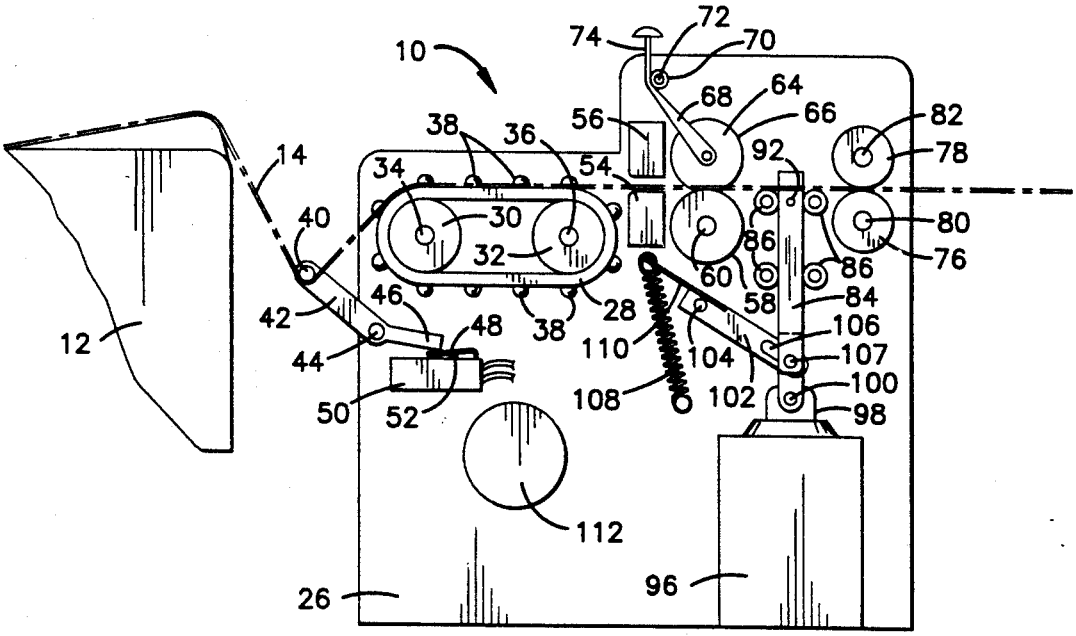
FIG. 2 is a diagrammatic side elevational view similar to FIG. 1, but showing the cutting device activated to effect a transverse cut along one of the fold lines of the printer paper and the tension bar pivoted to trip an associated microswitch.
Figure 3:
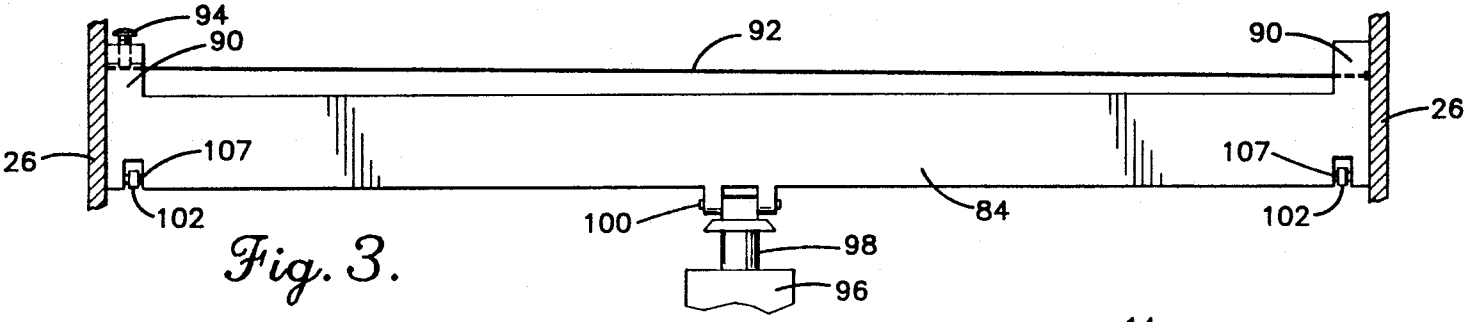
FIG. 3 is a fragmentary sectional view taken generally along line 3—3 of FIG. 1 in the direction of the arrows.

As best shown in FIG. 3, the cutter bar 84 extends transversely between the opposite sides of the frame 26. The main body of the cutter bar 84 underlies the paper sheet 14. On its opposite ends, the cutter bar 84 includes a pair of upwardly extending blocks 90 between which a thin cutter wire 92 extends in a taut condition. One end of the wire 92 is secured to one of the blocks 90, and the opposite end of the wire is secured by a set screw 94 which is threaded into the other block 90. The wire 92 is held in a tense condition by the set screw 94. When the cutter bar 84 is in the normal position shown in FIG. 1, the wire 92 is located above the plane of the paper sheet 14. However, when the cutter bar 84 is pulled downwardly to the position shown in FIG. 2 to effect a cutting stroke, the wire 92 is pulled downwardly with the cutting bar and passes below the plan of the sheet 14.

The cutting wire 92 extends transversely across the width of the frame 26 and inclines upwardly from one end to the other. With particular reference to FIG. 3, the end of the wire 92 which is held by the set screw 94 is slightly higher than the opposite end of the wire. Consequently, when the wire is pulled through the paper during a cutting stroke, the lower end of the wire contacts the paper first so that the paper is progressively cut from one side toward the other along each fold line 24. This assure that the paper will be separated cleanly along each of the fold lines 24 and will not inadvertently become torn at the main body 14 of the paper. The inclined orientation of the cutter wire 92 thus assures that each individual page of the printer paper will be cleanly separated along the fold line 24.

A solenoid 96 is used to effect the cutting strokes of the cutting mechanism. The solenoid 96 is conventional and has a core 98 which is normally in the extended position shown in FIG. 1. However, when the solenoid 96 is energized, the core 98 is magnetically retracted downwardly to the position shown in FIG. 2. The top end of the core 98 is pivotally connected at 100 with the bottom edge of the cutter bar 84 in order to pull the cutter bar downwardly when the solenoid core is retracted.

A return mechanism for the cutter bar 84 includes a pair of pivot arms 102. One end of each arm 102 is pivoted at 104 to the frame 26. The opposite end of each arm 102 is provided with an elongated slot 106 through which a pin 107 extends. The pins 107 are aligned with one another and are located in recesses near opposite ends of the cutter bar 84, as best shown in FIG. 3. A tension spring 108 is hooked to the frame 26 at its lower end and at its upper end is connected to a projecting tongue 110 on the arm 102.

When the solenoid 96 is energized to pull the cutter bar 84 downwardly to the position shown in FIG. 2, the interaction of the pins 108 in the slots 106 cause arms 102 to pivot in a clockwise direction about the pivot connections 104, thus placing the springs 108 under tension. When the solenoid 96 is thereafter deenergized, each spring pulls downwardly on tongue 110 and thus pivots the arms 102 in a counterclockwise direction to push the cutter bar 84 upwardly to the position of FIG. 1. The spring 108 is then in an undeformed condition. In this manner, spring 108 effects an upward return stroke of the cutter bar 84 at the end of each cutting stroke.

The drive system for the components of the device 10 includes a conventional electric motor 112. As shown in FIG. 4, the motor 112 drives an output pulley 114 which receives a belt 116. Belt 116 is also drawn around another pulley 118 which is mounted on shaft 34, thus driving shaft 34 and the driven feed wheels 30 whenever the motor is energized. Pulley 118 is a double pulley which receives a second belt 120 that is drawn around another pulley 122. Pulley 122 is mounted on shaft 60 in order to drive the grooved roller 58 whenever the motor 112 is energized. Pulley 122 is a double pulley which receives a second belt 124. The belt 124 is drawn around another pulley 126 which is mounted on shaft 80, thus driving the powered take up roller 76 whenever the drive motor is energized.

Figure 5:
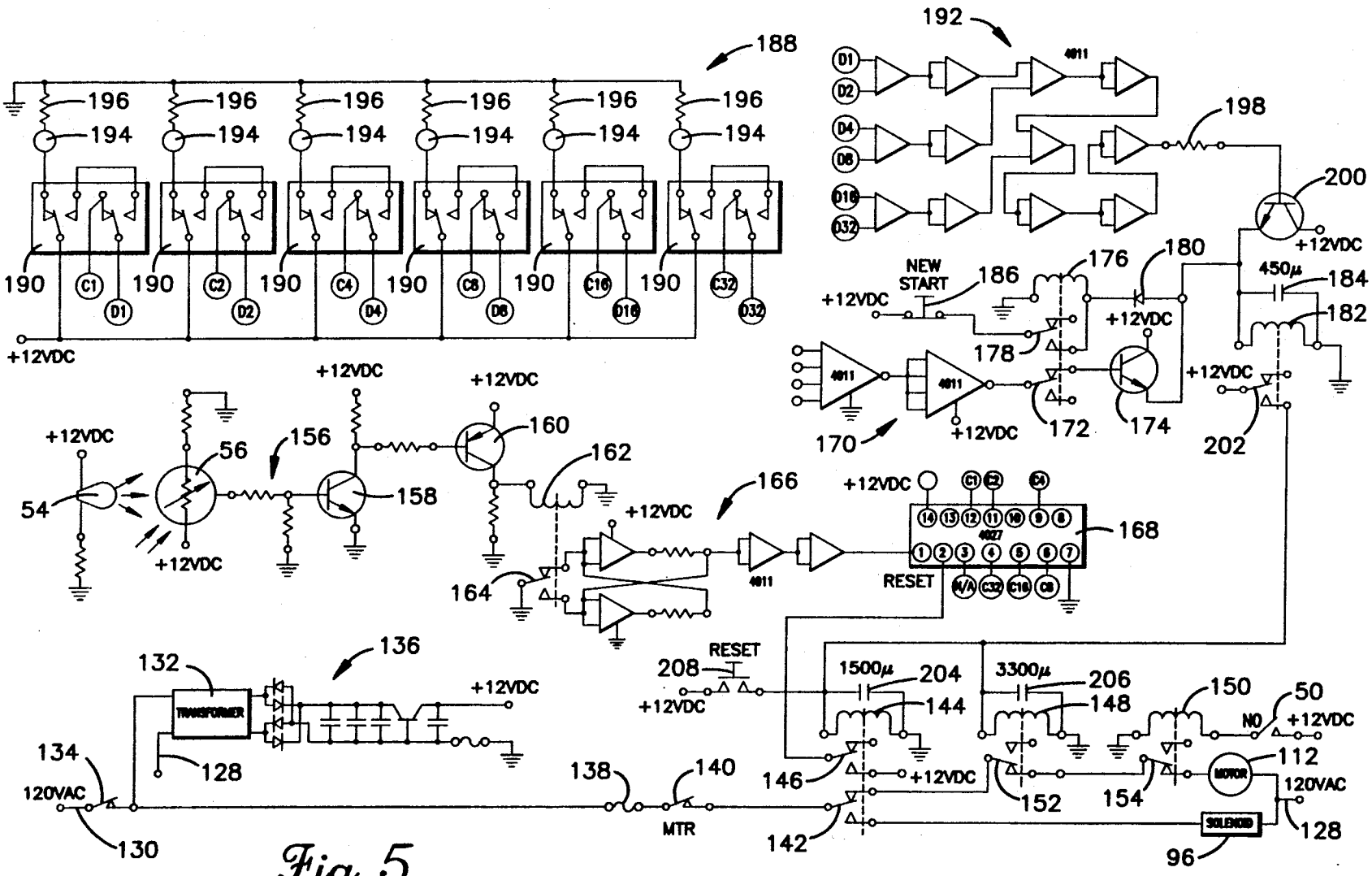
FIG. 5 is a schematic diagram of the control system for the printer accessory.

FIG. 5 depicts in schematic form the control system which controls operation of the device 10. Incoming AC power is applied along respective hot and neutral AC lines 128 and 130 to a transformer 132. A main power switch 134 is provided in the neutral line 130. The output of the transformer 132 connects with a conventional 12 volt DC power supply 136 which provides a positive 12 volt DC regulated output.

The AC neutral line 130 is provided with a suitable fuse 138 and with an on/off switch 140 which is used to control power to the drive motor 112. The application of power to the motor 112 and solenoid 96 is also controlled by a relay contact 142 which is operated by a relay coil 144 along with another contact 146 of the relay. Additional relay coils 148 and 150 control additional sets of contacts 152 and 154, respectively. When switches 130 and 140 are closed and all of the relay coils 144, 148 and 150 are deenergized, an AC circuit is completed to the motor 112 through the relay contacts and switches. If either of the relay coils 148 or 150 is energized, its associated relay contacts open and interrupt the application of power to the motor 112, thus deenergizing the motor. If relay coil 144 is energized, its contact 144 switches so that the solenoid 96 is then energized through the AC circuit established by the switches 134 and 140 and relay contact 142.

Relay coil 150 is controlled by the tension microswitch 50 which is normally open to deenergize coil 150. However, when switch 50 is closed, coil 150 is energized to open its normally closed relay contacts 154.

With continued reference to FIG. 5, the output from the photoreceiver 56 is applied through a resistor network 156 to the base of a transistor 158. When transistor 158 is in a conductive state, it pulls the base of another transistor 160 from its normally high state to a low state. The output of transistor 150 is applied to a relay coil 162 which controls a relay contact 164. Each time one of the marginal perforations 22 is aligned with the photocell, the relay 162 is active. As the printer paper passes the photocell, relay contact 164 thus applies a low signal alternately to the two inputs of a bounceless electronic switch 166. The output from the switch 166 provides a pulse to a BCD counter 168 each time one of the perforations 22 passes the photocell. The counter 168 increments its count state by a value of one each time it receives a pulse from the bounceless switch 166. The reset terminal of counter 168 is connected with relay contact 146, and a reset signal is thus applied to the counter 168 (resetting it to a count state of zero) each time relay coil 144 is energized to apply a positive signal through contact 146.

A "throw away" counter circuit 170 receives as its input the output from the BCD counter 166 which represents the current count state of the counter. When the count state of the counter reaches a selected value which is preset in the throw away counter circuit 170, an output signal from the throw away counter 170 is applied to a relay contact 172. In the normally closed state of relay contact 172, it connects the output from counter 170 to the base of a transistor 174. The relay contact 172 is controlled by a relay coil 176 along with a second relay contact 178. When the transistor 174 is conductive, it applies a positive voltage through a diode 180 to the relay coil 176. The output from the transistor 174 is also applied to a relay coil 182 which is connected in parallel with a time delay capacitor 184.

Relay contact 178 forms part of a holding circuit for coil 176, and the holding circuit also includes a normally closed push button switch 186 which normally makes 12 volt DC power available to contact 178. When relay coil 176 is energized, its relay contacts 172 and 178 are switched, with relay contact 178 thereafter maintaining coil 176 in an energized state so long as switch 186 remains closed. When contact 172 is switched, the throw away counter circuit 170 is isolated from further effect on the circuitry until coil 176 is deenergized.

The control circuitry includes a paper length select circuit which is generally identified by numeral 188 and which is set to correspond with the length of the individual pages of the printer paper between the adjacent fold lines 24. The paper length select circuit 188 includes a series of double throw switches 190 which are manually set to select the value of the count state of counter 168 which corresponds with the number of perforations between adjacent fold lines 24 of the printer paper which is being handled at the time. Each switch 190 represents one binary digit for the count state of the counter. The output signals from the counter 168 are applied to the respective switches 190 of the paper length select circuit 188. When the switches 190 are at the setting depicted in FIG. 5, the inputs to the respective switches are passed through the switches and are then applied as inputs to a BCD decoder circuit which is generally identified by numeral 192. In addition, a visual indicator 194 for each switch is energized. The indicators 194 are arranged in series with resistors 196 and are energized through the switches 190 in the setting shown in FIG. 5.

When any of the switches 190 is set at its other setting, the positive 12 volt line connects through the switch contacts directly with the output terminal of the switch, and the corresponding input to the BCD decoder circuit 192 is thus set constantly in a high state.

The switches 190 are set in accordance with the number of perforations 22 that are located between adjacent fold lines 24 of the particular printer paper 14 that is being handled at the time. For example, if there are 15 perforations between each pair of fold lines, the paper length select circuit 188 should be set to the binary number 111 which represents the decimal number 15. In this case, the first four of the switches 190 are set in the position shown in FIG. 5 and the last two switches are switched to the other switch setting. The indicators 194 for the first four switches are energized to visually indicate the switch setting. Only when the count state of the counter circuit 168 reaches a value of 15 are all switch outputs of the paper length select circuit 188 placed in a high state. Then, the BCD decoder circuit 192 provides an output signal.

The output from circuit 192 is applied through a resistor 198 to the base of a transistor 200. The output from the transistor 200 is applied to relay coil 182 and the time delay capacitor 184 in parallel.

Relay coil 182 controls a normally open relay contact 202 which closes upon energization of coil 182 to then apply 12 volt power to relay coils 144 and 148 which are arranged in parallel with respective capacitors 204 and 206. The capacitance of the capacitor 206 is greater than that of capacitor 204, and capacitor 204 in turn has a greater capacitance than capacitor 184. A push button reset switch 208 applies power to relay coils 144 and 148 when depressed.

In use of the device 10, the main power switch 134 is closed to make 12 volt DC power available at the output of the power supply 136. The new start switch 186 is then depressed to assure that relay coil 176 is deenergized. The reset switch 208 is depressed to briefly energize relay coil 144 so that a reset signal is applied to the counter 168 through relay contact 146. This resets the count state of the counter 168 to a value of zero. The switches 190 of the paper length select circuit 188 should be set properly for the length of the individual pages of the paper that is being handled by the printer 12.

The leading end of the paper that is discharging from the printer 12 is drawn beneath the tension bar 40 and is applied to the drive belts 28 by inserting the perforations 22 onto the teeth 38 of the drive belts. When the motor power switch 140 is then closed, the device 10 is placed in the automatic mode of operation and will automatically cut and trim the paper.

When the motor power switch 140 is closed, the motor 112 is energized and advances the leading end of the paper to the photoemitter 54 and photoreceiver 56. Each time one of the perforations 22 thereafter passes the photocell, the count state of the counter 168 is incremented by one. The count state value necessary to activate the throw away counter circuit 170 is selected to correspond with the distance between the photocell and the cutting station located directly below the cutter wire 92. By way of example, if the distance between these two locations corresponds to a length of paper that has six of the perforations 22, the count value that activates the throw away counter circuit 170 is selected to be six or the binary number 110.

When the leading edge of the paper 14 is aligned directly beneath the cutter wire 92, the throw away counter 170 is activated and provides an output signal to transistor 174, and relay coil 176 is then energized through transistor 174 and diode 180. Relay contact 178 is switched to maintain coil 176 energized so long as the new start switch 186 remains closed. The other relay contact 172 is also switched to isolate the throw away counter circuit 170 from the rest of the circuitry so long as the coil 176 remains energized.

The output signal from transistor 174 is also applied to relay coil 182. Because the capacitor 184 is arranged in parallel with coil 182, the relay coil remains energized for a selected time period after the initial energizing signal is interrupted.

When coil 182 is energized, its relay contact 202 makes power available to the relay coils 144 and 148. Again, the presence of the capacitors 204 and 206 in parallel with the relay coil maintains the coils in the energized state even after the relay contact 202 opens again. It is noted that capacitor 204 has a lesser capacitance value than capacitor 206, so relay coil 148 remains energized for a longer time period than coil 144. Coil 182 remains energized for a shorter time than either coil 144 or 148 due to the relatively small capacitance of capacitor 184.

When coil 148 is energized, its relay contact 152 is switched to interrupt the circuit to the drive motor 112, thus deenergizing the drive motor and stopping the advance of the paper. Energization of relay coil 144 switches its relay contact 146 to apply a reset signal to the counter 168. Relay contacts 142 are also switched, and this interrupts the drive motor circuit and completes a circuit to the solenoid 96 which is then energized to effect a cutting stroke of the cutter bar 84 and cutter wire 92.

When capacitor 204 is discharged, relay coil 144 is deenergized and contacts 142 open the energizing circuit for the solenoid 96. The spring return mechanism activated by the tension spring 108 then returns the cutter wire 92 to the position of FIG. 1. It is noted that the motor 112 remains deenergized at this time because relay coil 148 remains energized to maintain relay contacts 152 open. However, after the cutter Wire has been returned by the spring return mechanism, capacitor 206 becomes discharged and relay coil 148 is then deenergized. Its relay contacts 152 then close, and the motor 112 is energized again to advance the paper 14.

The drive motor operates until the counter circuit 168 reaches the count state set by the switches 190 of the paper length select circuit 188. Then, all outputs from circuit 188 are in a high state, and the decoder circuit 192 provides a signal making transistor 200 conductive. Relay coil 182 is energized again through transistor 200, and its contacts 202 then close. The motor is deenergized for a selected time period (determined by the time period that relay coil 148 remains energized), the solenoid is energized for a shorter time period to effect a cutting stroke of the cutter wire 92, and the motor is energized again as soon as relay coil 148 reverts to the deenergized state. The cutting stroke carries the cutter wire 92 through the fold line 24 Which is aligned with the cutter wire, and this severs the leading page of the paper 14 from the remainder of the paper sheet. At the time each cutting stroke is effected, the paper is held tautly between the take up rollers 76 and 78 and the drive belt 28 to assure a clean separation of the leading page. Each page that is separated from the sheet is advanced by the take up rollers 76 and 78 and deposited in a tray or other device (not shown). The pages are thus stacked in succession in the tray.

The device 10 continues to operate automatically in this fashion following the start cycle when the leading edge of the sheet 14 is advanced to the cutting station, the sheet is advanced in successive increments by a distance equal to the page length, the motor is stopped at the end of each incremental advance, and the leading page is separated from the sheet by the cutter wire.

If the drive system of the printer 12 stops, the device 10 continues to advance the paper 14. However, the paper is quickly placed under considerable tension by the drive system of the device 10, and the paper pulls the tension bar 40 upwardly to the position shown in FIG. 2, thereby closing the microswitch 50. As shown in FIG. 5, closing of the microswitch 50 causes relay coil 150 to become energized, thus opening its relay contacts 154 and interrupting the circuit to the drive motor 112. The motor 112 is thereby deenergized until such time as the printer drive system begins operation again to relieve the tension in the paper 14 and permit lever 42 to pivot sufficiently to open the microswitch 50.

It is noted that relay coil 176 remains energized during the normal operating cycle of the machine after the initial start up cycle. Also, the throw away counter 170 is locked out of the circuit during the normal operating cycle. When a new sheet of paper is loaded into the device 10, it is necessary to momentarily depress the new start switch 186 to deenergize relay coil 176. This brings the throw away counter 170 back into the control circuit during the initial start up cycle for the new sheet of paper, although the throw away counter is thereafter locked out of the circuit again during the subsequent normal operating mode of the machine. In this manner, the operation of the throw away counter circuit assures that the leading edge of each new sheet that is handled by the device is initially advanced into alignment with the cutter wire 92 during the start up cycle. Thereafter, the paper length select circuit 188 controls the stopping of the motor and operation of the cutting mechanism to make certain that each page is cut precisely at the location of the fold line 24.

As the sheet 14 is advanced through the device 10, one or both of the margin strips 18 may be cut away from the sheet by the cutter wheels 64. In order to activate each cutter wheel 64, the handle 74 is pushed to lower the cutter wheel 64 to the engaged position where it enters the corresponding groove 62 in the underlying roller 58 and acts to cleanly and continuously cut through the tear line 20 for cutting away of the tear strip 18.

If there is no need or desire to cut away one or both of the tear strips 18, the appropriate cutter wheel or wheels can be moved to the disengaged position shown in broken lines in FIG. 1 by pulling on the handle 74. Then, the paper passes beneath the cutter wheel and the tear lines 20 are not cut.

The adjustability of one set of the feed wheels 30 and 32 allows the device to handle printer paper that differs in width. Likewise, the ability to set the switches 190 to any desired count value allows paper having different length pages to be handled. These adjustments, together with the ability to engage or release the cutter wheels 64, provide the device 10 with the versatility to handle virtually any size and type of printer paper. It is also important to recognize that the machine operates automatically with only minimal operator input and thus avoids the risk of human error.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. Apparatus for use with a printer which discharges printer paper in a continuous sheet having longitudinal tear lines adjacent the side edges thereof to define perforated margin strips and transverse weakened fold lines about which individual pages of the sheet may be folded, said apparatus comprising:

a frame defining a cutting station;

feed wheel means on the frame for receiving the paper discharged from the printer, said feed wheel means having teeth for entry into the perforations of the margin strips to advance the sheet when said feed wheel means is activated;

take up roller means on the frame downstream from said feed wheel means for receiving and advancing a leading end portion of the sheet to maintain the sheet under tension in extension between the feed wheel means and the take up roller means, said cutting station being located between said feed wheel means and said take up roller means;

power means for driving said feed wheel means and said take up roller means;

a cutter wire having opposite ends;

a rigid cutter bar carrying said cutter wire in a taut condition in which said wire extends generally across a sheet stretched between said feed wheel means and said take up roller means, with said wire having an inclined orientation wherein one end of the wire is closer to the sheet than the other end of the wire;

means for mounting said cutter bar on the frame at said cutting station for movement along a linear path carrying the wire through a cutting stroke in which the wire progressively passes through the plane of a sheet stretched between said feed wheel means and said take up roller means;

means for determining each time the sheet is located with one of the fold lines at said cutting station; and means for deactivating said feed wheel means and said take up roller means and for effecting said cutting stroke each time the sheet is located with one of the fold lines at said cutting station, thereby cutting the sheet along each of the fold lines with each cut being made progressively across the sheet by said wire.

2. Apparatus as set forth in claim 1, including means for deactivating said feed wheel means and said take up roller means when the tension in the sheet between in printer and the feed wheel means exceeds a selected level.

3. Apparatus as set forth in claim 1, including:

a tension bar mounted on the frame for movement between first and second positions, said sheet being drawn around said tension bar at a location between the printer and the feed wheel means and moving the tension bar to the second position when the feed wheel means pulls the sheet sufficiently to stretch the sheet beyond a selected level; and means for deactivating said feed wheel means and said take up roller means when the tension bar is in said second position.

4. Apparatus as set forth in claim 1, including means on said frame for cutting the sheet along both of the longitudinal tear lines to remove the margin strips from the sheet.

5. Apparatus as set forth in claim 4, wherein said cutting means comprises a pair of cutting elements mounted on the frame between said feed wheel means and said take up roller means and operable to effect cuts along respective tear lines as the sheet is advanced from the feed wheel means to the take up roller means.

6. Apparatus as set forth in claim 4, wherein said cutting means comprises:

a pair of cutter wheels mounted on the frame for rotation at spaced apart locations, each cutter wheel having a peripheral cutting edge for cutting the tear line on the sheet;

a roller mounted on the frame for rotation in opposition to each cutter wheel to hold the sheet against the cutter wheel; and means for rotating said roller.

7. Apparatus as set forth in claim 6, including a groove said roller at a location to align with and receive each cutting edge.

8. Apparatus as set forth in claim 6, including means for mounting each cutter wheel on the frame for movement toward and away from the roller between an engaged position wherein the cutter wheel is effective to cut the tear line and a release position wherein the cutter wheel is displaced from the sheet and is ineffective to cut the tear line.

9. Apparatus as set forth in claim 6, including means for adjusting the spacing between said cutter wheels to accommodate sheets having different dimensions between the tear lines thereof.

10. Apparatus as set forth in claim 1, wherein said determining means comprises means for counting the number of perforations passing a preselected location.

11. Apparatus as set forth in claim 10, including means for stopping the sheet when the counting means has initially counted a number of perforations corresponding to the distance between said preselected location and said cutting station.

12. Apparatus for use with a printer which discharges printer paper in a continuous sheet having side margin strips presenting equally spaced perforations and equally spaced transverse fold lines about which individual pages of the sheet may be folded, said apparatus comprising:

a frame;

means on said frame for advancing the sheet along a prescribed path;

cutting means located at a cutting station on the frame for cutting transversely through the sheet when activated;

means for counting the number of perforations passing a preselected location along the path to measure the length of the sheet beyond said preselected location, said counting means having a count state that is incremented each time one of the perforations passes said preselected location;

means for resetting said counting means each time the count state of the counting means is at a preset value indicating that a fold line is at the cutting station; and control means, operable each time the count state of said counting means reaches said preset value, for deactivating said advancing means for a selected time period and activating said cutting means to cut the sheet along a fold line prior to activating said advancing means again, whereby individual pages are successively separated from the sheet of printer paper.

13. Apparatus as set forth in claim 12, including means for adjusting said preset value to accommodate sheets having different dimensions between the fold lines.

14. Apparatus as set forth in claim 12, wherein said control means includes:

a first circuit, operable only during a start cycle when a leading edge of the sheet is being advanced along said path, for deactivating the advancing means for a predetermined time period when the count state of the counting means reaches a value indicating that the leading edge of the sheet has advanced to said cutting station;

means for resetting said counting means at the end of said start cycle; and a second circuit, operable subsequent to said start cycle, for deactivating said advancing means for a selected time period and activating said cutting means to cut the sheet along a fold line prior to activating said advancing means again, whereby individual pages are successively separated from the sheet off printer paper.

* * * * *